US006384357B1

(12) United States Patent
Morrison

(10) Patent No.: US 6,384,357 B1
(45) Date of Patent: May 7, 2002

(54) SWITCH WITH CANTILEVERED DETENT MECHANISM

(75) Inventor: Scott A. Morrison, Fenton, MI (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/708,986

(22) Filed: Nov. 8, 2000

(51) Int. Cl.[7] ..... H01H 13/14

(52) U.S. Cl. ..... 200/520; 200/565; 200/548; 200/539

(58) Field of Search ..... 200/565, 548, 200/539, 571, 336, 11 G

(56) References Cited

U.S. PATENT DOCUMENTS

| | | | | |
|---|---|---|---|---|
| 2,528,115 A | | 10/1950 | Clayton | |
| 3,912,887 A | | 10/1975 | Gratz et al. | |
| 4,075,442 A | | 2/1978 | Fukuda et al. | |
| 4,082,925 A | * | 4/1978 | Hufford | 200/11 G |
| 4,311,885 A | | 1/1982 | Arthur | |
| 4,441,000 A | | 4/1984 | Suwa | |
| 4,816,626 A | | 3/1989 | Valenzona et al. | |
| 5,122,627 A | * | 6/1992 | Trana | 200/548 |
| 5,557,081 A | | 9/1996 | Clevenger et al. | |
| 6,206,732 B1 | * | 3/2001 | Fukuda | 439/630 |

* cited by examiner

*Primary Examiner*—Lincoln Donovan
*Assistant Examiner*—Kyung S. Lee
(74) *Attorney, Agent, or Firm*—Tarolli, Sundheim, Covell, Tummino & Szabo L.L.P.

(57) ABSTRACT

A switch (10) comprises a printed circuit board (12). The printed circuit board (12) has a plurality of electrical contacts. The switch (10) further comprises a carrier (18) having an electrical conductor (102) for connecting at least two of the plurality of electrical contacts. The carrier (18) is movable relative to the printed circuit board (12). The carrier (18) further has a surface (92) having a plurality of undulations (96). The switch (10) further comprises at least one flexible plastic cantilever portion (56, 58) of a plastic member housing the carrier. The cantilever portion contacts the plurality of undulations (96). The undulations (96) and the cantilever portion (56, 58) comprise a detent mechanism to restrain the carrier (18) in a position to which the carrier (18) is moved.

7 Claims, 4 Drawing Sheets

SWITCH WITH CANTILEVERED DETENT MECHANISM

TECHNICAL FIELD

The present invention relates to a switch having a carrier that is movable relative to a printed circuit board and a detent mechanism for retaining the carrier in a position to which it is moved.

BACKGROUND OF THE INVENTION

A known switch, shown in U.S. Pat. No. 5,557,081, has a detent mechanism. The detent mechanism includes a hollow cylindrical post that extends from a movable carrier. The detent mechanism also includes a surface having a plurality of semi-cylindrical grooves. The hollow cylindrical post receives a spring and a spherical ball. The hollow cylindrical post is positioned relative to the surface having the grooves such that the spring biases the ball into a groove. When the carrier of the switch is moved, the spring is compressed allowing the ball to move out of a respective groove and to ride over the surface toward an adjacent groove. When the ball reaches the adjacent cylindrical groove, the ball becomes biased into the groove and provides resistance to movement of the carrier.

Another known switch, shown in U.S. Pat. No. 4,441,000, also has a detent mechanism. The switch includes a guide wall having a plurality of recesses. The slide member has an arched spring with a semi-circular projection. The slide member is positioned relative the guide wall such that the semi-circular projection of the arched spring is biased into one of the recesses of the guide wall. When the slide member is moved linearly, the arched spring flexes as the semi-circular projection is moved out of the recess. As the semi-circular projection encounters an adjacent recess in the guide wall, the arched spring biases the projection into the adjacent recess.

SUMMARY OF THE INVENTION

The present invention is a switch comprising a printed circuit board. The printed circuit board has a plurality of electrical contacts. The switch further comprises a carrier having an electrical conductor for connecting at least two of the plurality of electrical contacts. The carrier is movable relative to the printed circuit board. The carrier has a surface having a plurality of undulations. The switch further comprises at least one flexible plastic cantilever portion of a plastic member housing the carrier. The cantilever portion contacts the plurality of undulations. The undulations and the cantilever portion comprise a detent mechanism to restrain the carrier in a position to which the carrier is moved.

BRIEF DESCRIPTION OF THE DRAWINGS

The foregoing and other features of the present invention will become apparent to those skilled in the art to which the present invention relates upon reading the following description with reference to the accompanying drawings, in which.

DESCRIPTION OF PREFERRED EMBODIMENT

Figure 1:
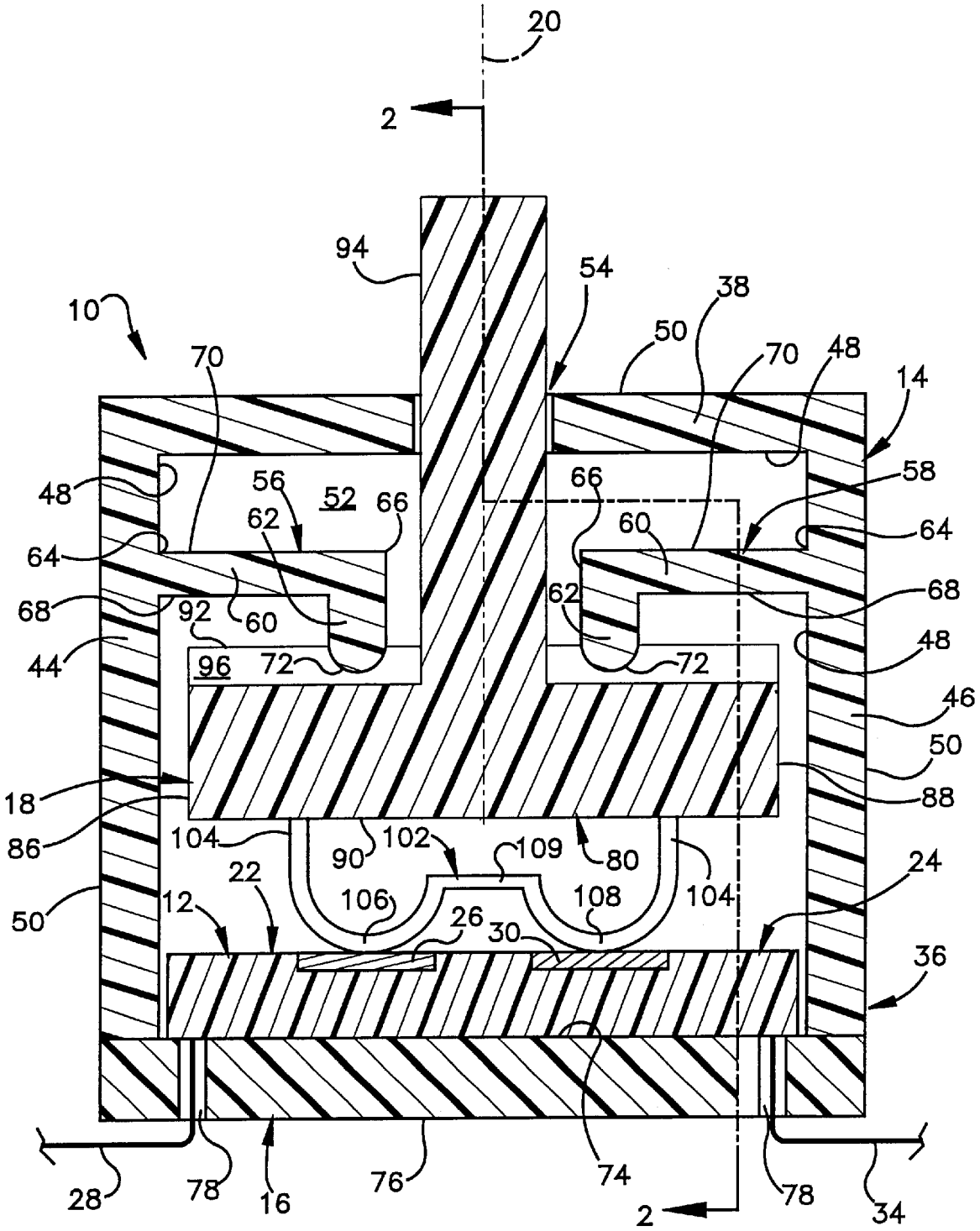
FIG. 1 is a sectional view of a switch embodying present invention.

FIG. 1 is a view of a switch 10 embodying the present invention. The switch 10 includes a printed circuit board 12, a housing 14, a cover 16, and a carrier 18. The carrier 18 is movable linearly relative to the printed circuit board 12 and the housing 14.

Figure 2:
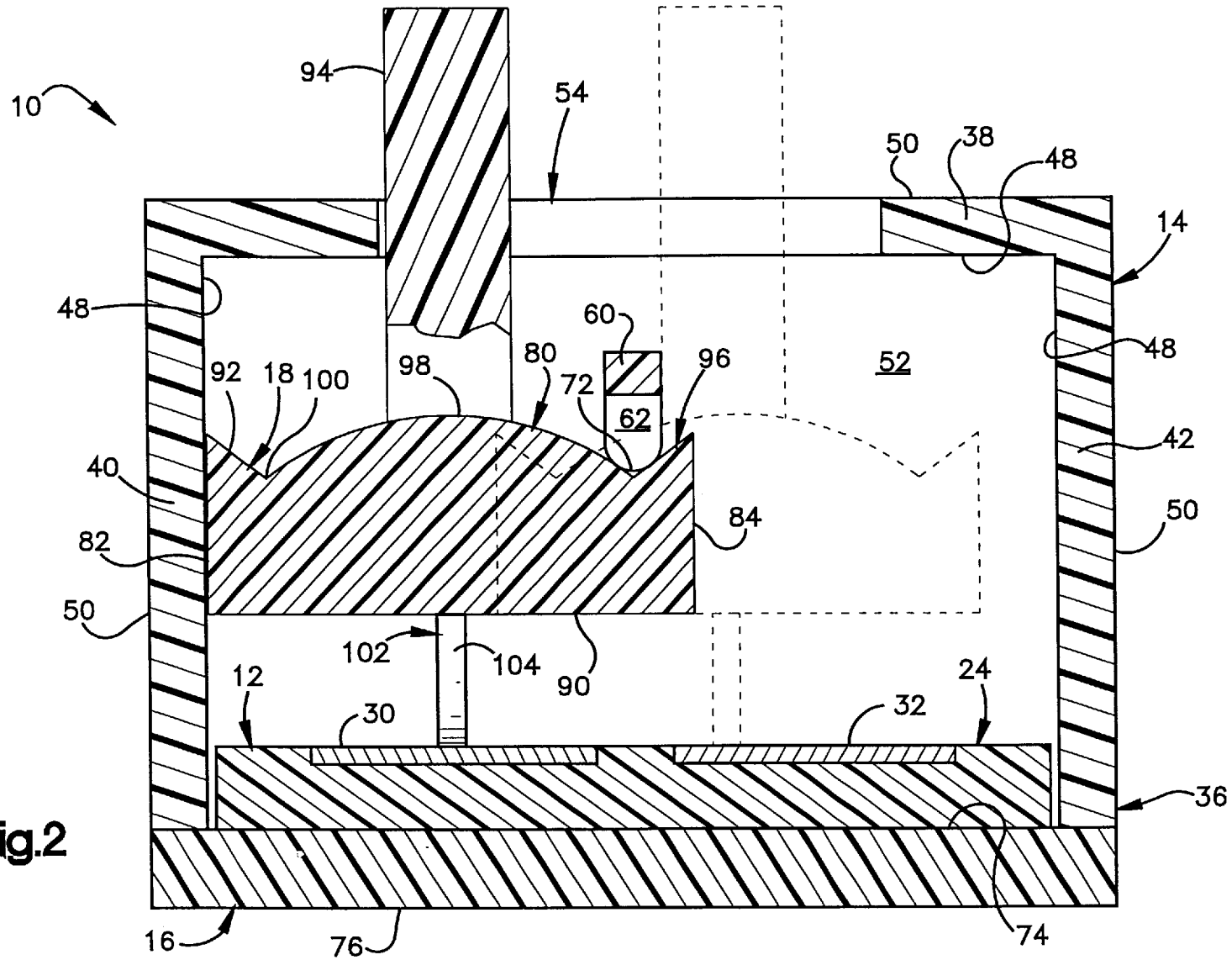
FIG. 2 is a view taken along line 2—2 of FIG. 1.

The printed circuit board 12 is a rectangular plate having a width, shown in FIG. 1, and a length, shown in FIG. 2. An imaginary plane 20 extends along the length of the printed circuit board 12 to divide the printed circuit board 12 in half along its width. Thus, the printed circuit board 12 has a first side 22 and a second side 24.

The printed circuit board 12 has three contacts. Those skilled in the art will recognize that the number of contacts on the printed circuit board 12 may be varied. A first contact 26 extends along the length of the first side 22 of the printed circuit board 12. A first electrical lead 28 connects to the first contact 26. Second and third contacts 30 and 32 (FIG. 2) are aligned along the length of the second side 24 of the printed circuit board 12. The second and third contacts 30 and 32, collectively, extend along the length of the second side 24 of the printed circuit board 12. Both the second and third contacts 30 and 32 extend parallel to a portion of the first contact 26 and are electrically insulated from each other and from the first contact 26. A second electrical lead 34 (FIG. 1) connects to the third contact 32 and extends away from the printed circuit board 12. No electrical lead is connected to the second contact 30.

The housing 14 is molded as one piece from plastic material. The housing 14 is a rectangular box having an open end 36. The housing 14 includes five walls. As shown in FIGS. 1 and 2, the five walls are a top wall 38 and four side walls 40, 42, 44, and 46. Each wall 38–46 is planar and rectangular in shape. Each of the walls 38–46 includes an inner surface 48 and an outer surface 50. The four side walls 40, 42, 44, and 46 each have interlocking portions (not shown) near the open end 36 of the housing 14 for interlocking with portions of the cover 16.

The top wall 38 forms a closed end of the housing. The open end 36 of the housing 14 is opposite the closed end. The open end 36 of the housing 14 leads into a central chamber 52 that is surrounded by the five walls 38, 40, 42, 44, and 46.

The chamber 52 has a width, defined as the distance between the inner surface 48 of side wall 44 and the inner surface 48 of side wall 46, that is greater than the width of the printed circuit board 12. The chamber 52 has a length, defined as the distance between the inner surface 48 of side wall 40 and the inner surface 48 of side wall 42, that is greater than the length of the printed circuit board 12.

An elongated slot 54 is centrally located on the top wall 38 of the housing 14. The elongated slot 54 extends from the inner surface 48 to the outer surface 50 of the top wall 38. The elongated slot 54 has a width, shown in FIG. 1, that is shorter than its length, shown in FIG. 2.

As shown in FIG. 1, two flexible plastic cantilever portions 56 and 58 extend from the housing 14 into the chamber 52. The cantilever portions 56 and 58 are molded as one piece with the housing 14. Each of the cantilever portions 56 and 58 has an arm portion 60 and a head portion 62.

Preferably, the arm portion 60 has a rectangular cross section, as shown in FIG. 2, and extends inwardly into the chamber 52 approximately one-third of the width of the chamber 52. The arm portion 60 has two axial ends 64 and 66. A first end 64 extends from the housing 14 and a second end 66 is suspended in the chamber 52. The second end 66 of the arm portion 60 supports the head portion 62. The arm portion 60 of each of the cantilever portions 56 and 58 is flexible such that the second end 66 of the arm portion 60 may be moved relative to the first end 64. The arm portion 60 of each of the cantilever portions 56 and 58 also has an inner surface 68 and an outer surface 70. The outer surface 70 is nearest the top wall 38 of the housing 14. The inner surface 68 is opposite the outer surface 70 and is nearest the carrier 18 in the assembled switch 10.

The head portion 62 of each of the cantilever portions 56 and 58 extends from the second end 66 of the arm portion 60. The head portion 62 extends perpendicular to the arm portion 60 and away from the inner surface 68 of the arm portion 60. The head portion 62 terminates in a rounded end 72.

As shown in FIG. 1, the two cantilever portions 56 and 58 extend from side wall 44 and side wall 46, respectively. The cantilever portion 56 extends from the side wall 44 at a location approximately 80% of the depth of the chamber 52 from the open end 36 of the housing 14 and equidistance from the side wall 40 and side wall 42 of the housing 14, as shown in FIG. 2. The outer surface 70 of the first cantilever portion 56 is nearest the top wall 38 of the housing 14. The arm portion 60 of the first cantilever portion 56 extends perpendicular to the inner surface 48 of side wall 44.

The second cantilever portion 58 extends from side wall 46 at a location approximately 80% of the depth of the chamber 52 from the open end 36 the housing 14 and equidistance from side wall 40 and side wall 42 of the housing 14. The outer surface 70 of the second cantilever portion 58 is nearest the top wall 38 of the housing 14. The arm portion 60 of the second cantilever portion 58 extends perpendicular to the inner surface 48 of side wall 46.

The cover 16 is rectangular in shape and has a length and a width equal to that of the housing 14. The cover 16 has an inner surface 74 and an outer surface 76. The inner surface 74 of the cover 16 has interlocking portions (not shown) for interlocking with portions of the four side walls 40, 42, 44, and 46. Preferably, the cover 16 will snap onto the housing 14 such that the cover 16 closes the open end 36 of the housing 14 and encloses the central chamber 52. Apertures 78 extend through the cover 16 for receiving electrical leads 28 and 34.

The carrier 18 has a main body portion 80 having six surfaces. The six surfaces of the carrier 18 include a top surface 92, a bottom surface 90, and four side surfaces 82, 84, 86, and 88 that interconnect the top surface 92 and the bottom surface 84. As shown in FIG. 1, the carrier 18 has a width that is slightly narrower than the width of chamber 52. The length of the carrier 18 is significantly less than the length of chamber 52 (FIG. 2). The main body portion 80 of the carrier 18 has a depth of approximately one-third the depth of the chamber 52, i.e., the distance from the inner surface 48 of the top wall 38 to the inner surface 74 of the cover 16 when the cover 16 is attached.

An actuator 94 extends from the center of the top surface 92 of the carrier 18. Preferably, the actuator 94 is plastic and is formed as one piece with the carrier 18. The actuator 94 is sufficiently rigid so as to provide a means for moving the carrier 18 and may include means for attaching a handle. The actuator 94 has a width that is slightly less than the width of the elongated slot 54 in the top wall 38 of the housing 14.

A plurality of undulations 96 extends across the top surface 92 of the carrier 18. Each undulation 96 has a peak 98 that extends across the width of the top surface 92 in a direction perpendicular to side surfaces 86 and 88 of the carrier 18. Adjacent undulations 96 are separated by a groove 100. Preferably, the number of grooves 100 is identical to the number of contacts on the second side 24 of the printed circuit board 12.

An electrical conductor 102 extends from the bottom surface 90 of the carrier 18. The conductor 102 has a W-shape with two leg portions 104 that connect to the bottom surface 90 of the carrier 18 and two intermediate arched portions 106 and 108 that are interconnected by a connecting portion 109. The two leg portions 104 of the conductor 102 are spaced across the width of the bottom surface 90 of the carrier 18 and the arched portions 106 and 108 extend from the bottom surface 90 a distance approximately equal to the depth of the main body portion 80 of the carrier 18. As shown in FIG. 1, the conductor 102 is centrally located across the width of the carrier 18 such that a first arched portion 106 is located nearer side surface 86 of the carrier 18 and a second arched portion 108 is located nearer side surface 88 of the carrier 18.

To assemble the switch 10, the carrier 18 is inserted into the chamber 52 through the open end 36 of the housing 14 such that the actuator 94 extends through the elongated slot 54 on the top wall 38. When the carrier 18 is properly inserted, the peaks 98 of the undulations 96 should extend in a direction perpendicular to the length of the elongated slot 54, as shown in FIG. 2. The printed circuit board 12 is then fixed to the inner surface 74 of the cover 16 and the electrical leads 28 and 34 of the printed circuit board 12 are extended through of the apertures 78 in the cover 16. The cover 16 is attached to the housing 14 such that the interlocking portions of the cover 16 interlock with the interlocking portions of the four side walls 40, 42, 44, and 46 of the housing 14. When the cover 16 is attached to the housing 14, the printed circuit board 12 will contact the electrical conductor 102 of the carrier 18. The first arched portion 106 of the electrical conductor 102 will contact the first side 22 of the printed circuit board 12 and the second arched portion 108 of the electrical conductor 102 will contact the second side 24 of the printed circuit board 12. When the printed circuit board 12 contacts the electrical conductor 102, the top surface 92 of the carrier 18 will be forced into contact with the head portion 62 of the cantilever portions 56 and 58 of the housing 14.

Preferably, the switch 10 of the present invention will be used in the instrument panel of a vehicle. The first electrical lead 28 that connects to the first contact 26 of the printed circuit board 12 will be connected to an energy source, such as the vehicle battery. The second electrical lead 34 that connects to the third contact 32 will be connected to an actuatable device.

Although those skilled in the art will recognize that the switch 10 may have a plurality of positions, for simplicity, operation of the switch 10 will be described with the switch 10 having only two positions. In the first position, shown in FIG. 2, the electrical conductor 102 of the carrier 18 connects the first contact 26 (FIG. 1) of the printed circuit board 12 to the second contact 30 of the printed circuit board 12. Thus, the first arched portion 106 of the electrical conductor 102 contacts the first contact 26 on the first side 22 of the printed circuit board 12 and the second arched portion 108 of the electrical conductor 102 contacts the second contact 30 on the second side 24 of the printed circuit board 12. Since the second contact 30 of the printed circuit board 12 does not connect to the device to be actuated, the switch 10 is in an open position and no energy is transferred to the device. When no energy is transferred to the device, the switch 10 is in an "off position." When in the "off position," the head portions 62 of the two cantilever portions 56 and 58 of the housing 14 are positioned in a groove 100 separating adjacent undulations 96.

When the actuator 94 is moved within the elongated slot 54, as shown by the dashed lines in FIG. 2, the carrier 18 is moved linearly within the chamber 52. Those skilled in the art will recognize that the housing 14 may have rails or other means for providing additional support to the carrier 18 during movement within the chamber 52. When the carrier 18 is moved, the head portion 62 of each cantilever portion 56 and 58 slides over the top surface 92 of the carrier 18. Thus, when the carrier 18 is moved, the head portion 62 begins to slide up an undulation 96 toward the peak 98 of the undulation 96. As the head portion 62 slides up an undulation 96, the arm portion 60 of each cantilever portion 56 and 58 flexes. When the head portion 62 reaches the peak 98 of the undulation 96, the second arched portion 108 of the electrical conductor 102 is between the second contact 30 and the third contact 32. As the head portion 62 passes the peak 98 of the undulation 96 and begins to slide down the undulation 96 to the next groove 100, the second arched portion 108 of the electrical conductor 102 begins to contact the third contact 32 of the printed circuit board 12. The resiliency of the arm portion 60 of each cantilever portion 56 and 58 forces the head portion 62 to slide into the next groove 100 on the top surface 92 of the carrier 18 to ensure that the electrical conductor 102 will fully contact the third contact 32. When the electrical conductor 102 contacts the third contact 32, electrical energy is transferred from the first contact 26 to the third contact 32 through the electrical conductor 102. Since the second electrical lead 34 connects the third contact 32 to the actuatable device, electrical energy is transferred to the device and the device is energized. When energy is transferred to the device, the switch 10 is closed and is in an "on position."

The undulations 96 and the cantilever portions 56 and 58, collectively, comprise a detent mechanism. When the head portion 62 of each cantilever portion 56 and 58 is centered between adjacent undulations 96, i.e., in a groove 100, the electrical conductor 102 of the carrier 18 will properly contact the contacts associated with the carrier 18 position. The undulations 96 also provide resistance to movement of the carrier 18 and thus, keep the switch 10 in the appropriate position. An additional benefit of the detent mechanism is that the switch 10 has a transition feel when being switched from one position to another. Since the cantilever portions 56 and 58 are molded as one piece with the housing 14 and the undulations 96 are molded on the carrier 18, the detent mechanism of the present invention includes no separate parts, such as a spring or a spherical ball.

Figure 3:
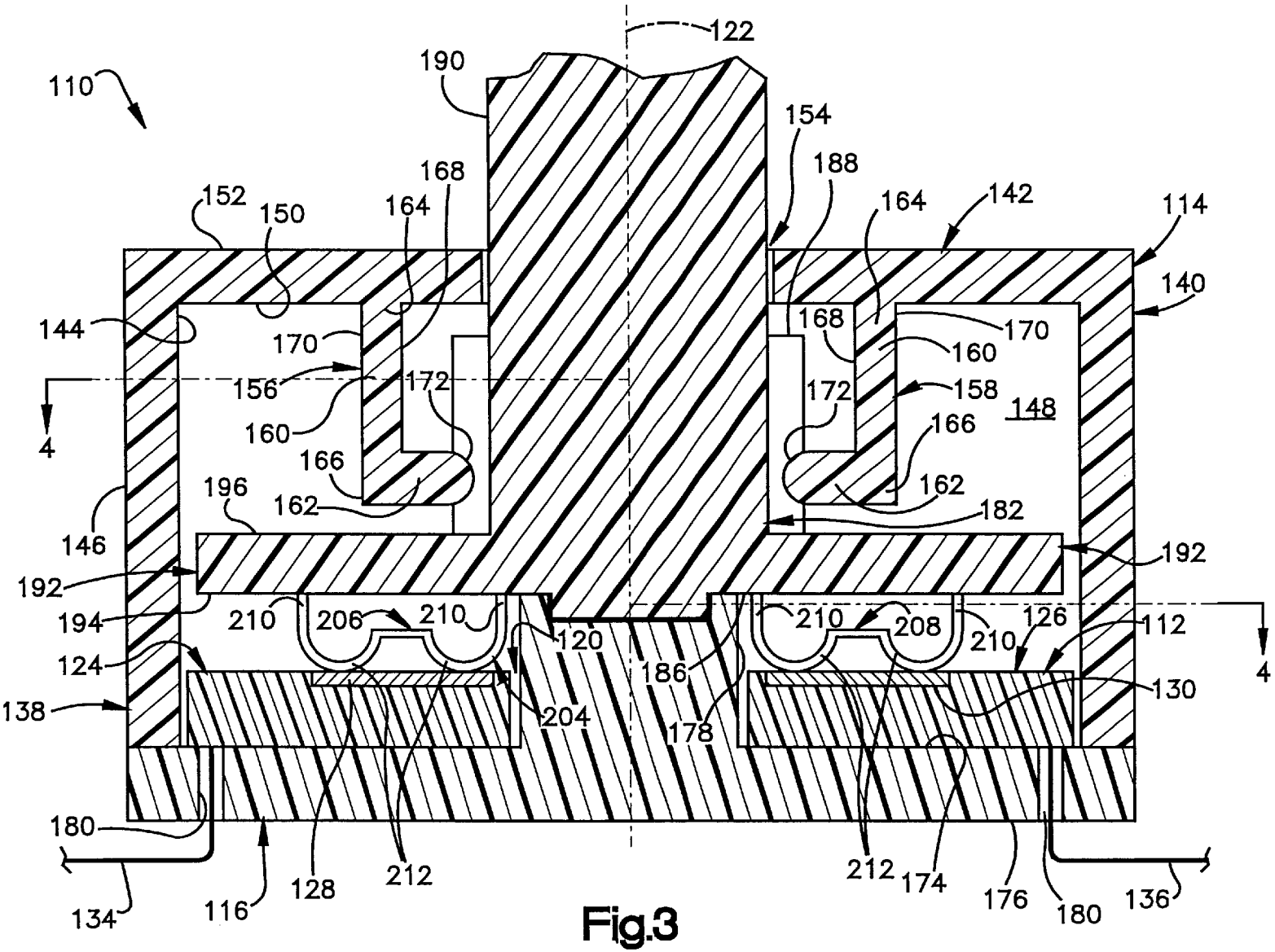
FIG. 3 is a sectional view of a second embodiment of a switch embodying the present invention.
Figure 4:
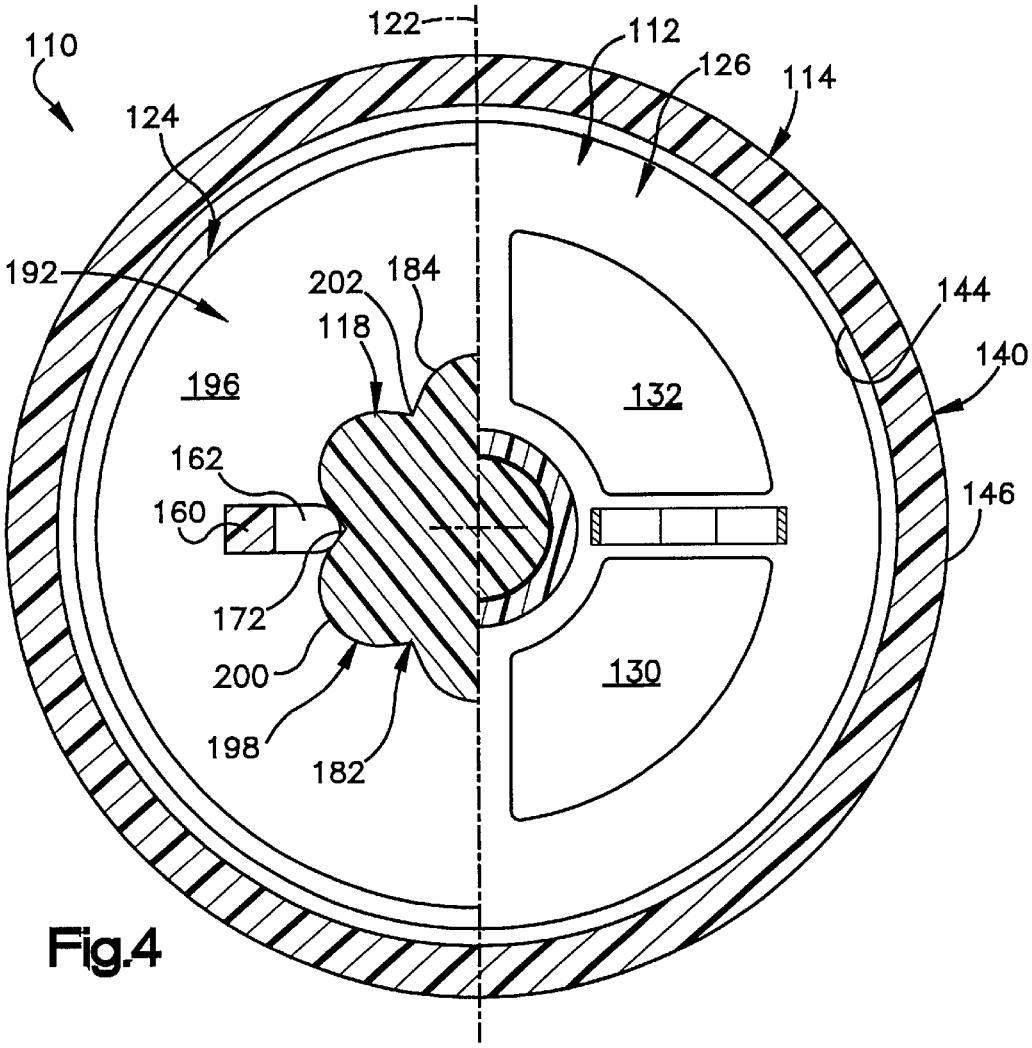
FIG. 4 is a view taken along line 4—4 of FIG. 3.

A second embodiment of a switch 110 embodying the present invention is illustrated in FIGS. 3 and 4. The switch 110 includes a printed circuit board 112, a housing 114, a cover 116, and a carrier 118. The carrier 118 is rotatable relative to the printed circuit board 112 and the housing 114.

The printed circuit board 112 is a circular plate. An aperture 120 extends through the center of the printed circuit board 112. An imaginary plane 122 divides the printed circuit board 112 in half forming a first side 124 and a second side 126.

The printed circuit board 112 has one contact on the first side 124 and two contacts on the second side 126. The first contact 128 extends around the arch of the first side 124 of the printed circuit board 112. The second and third contacts 130 and 132 (FIG. 4), collectively, extend around the arch of the second side 126 of the printed circuit board 112. The second and third contacts 130 and 132 are electrically insulated from each other and from the first contact 128. A first electrical lead 134 connects to the first contact 128. A second electrical lead 136 connects the third contact 132. No electrical lead is connected to the second contact 130.

The housing 114 is cylindrical and has an open end 138 and a closed end. The housing 114 is molded as one piece and includes a cylindrical side wall 140 and a top wall 142. The side wall 140 includes an inner surface 144 and an outer surface 146. The side wall 140 also has interlocking portions on the open end 138 for interlocking with portions of the cover 116. The top wall 142 forms the closed end of the cylindrical housing 114. The open end 138 of the cylindrical housing 114 is opposite the closed end and leads into a central chamber 148. The top wall 142 also includes an inner surface 150 and an outer surface 152. A central bore 154 extends through the top wall 142 of the housing 114.

Two flexible plastic cantilever portions 156 and 158 extend from the housing 114 into the chamber 148. The cantilever portions 156 and 158 are molded as one piece with the housing 114. Each of the cantilever portions 156 and 158 has an arm portion 160 and a head portion 162.

Preferably, the arm portion 160 has a rectangular cross section, as shown in FIG. 4, and extends inwardly into the chamber 148 approximately 40% the depth of the chamber 148. The arm portion 160 has two axial ends 164 and 166. A first end 164 extends from the housing 114 and a second end 166 is suspended in the chamber 148. The second end 166 of the arm portion 160 supports the head portion 162. The arm portion 160 of each of the cantilever portions 156 and 158 is flexible such that the second end 166 of the arm portion 160 may be moved relative to the first end 164. The arm portion 160 of each of the cantilever portions 156 and 158 also has an inner surface 168 and an outer surface 170. The outer surface 170 is nearest the side wall 140 of the housing 114. The inner surface 168 is opposite the outer surface 170 and is nearest the carrier 118 in the assembled switch 110.

The head portion 162 of each of the cantilever portions 156 and 158 extends from the second end 166 of the arm portion 160. The head portion 162 extends perpendicular to the arm portion 160 and away from the inner surface 168 of the arm portion 160. The head portion 162 terminates in a rounded end 172.

In FIGS. 3 and 4, the two cantilever portions 156 and 158 extend from the inner surface 150 of the top wall 142 of the housing 114. The two cantilever portions 156 and 158 are located on opposite sides of the central bore 154 and are 180 degrees from one another. Preferably, the two cantilever portions 156 and 158 are equidistance from the central bore 154. The head portion 162 of a first cantilevered portion 156 extends toward the head portion 162 of a second cantilevered portion 158. The arm portions 160 of each of the cantilever portions 156 and 158 extend perpendicular to the inner surface 150 of the top wall 142.

The cover 116 is a circular plate having a diameter equal to the diameter of the cylindrical side wall 140. The cover 116 has an inner surface 174 and an outer surface 176. An annular projection 178 extends inwardly from the center of the inner surface 174 of the cover 116. The outer surface 176 of the cover 116 is flat. The cover 116 has interlocking portions for interlocking with portions of the side wall 140 of the housing 114. Ideally, the cover 116 will snap onto the housing 114 to cover the open end 138 of the housing 114 and enclose the central chamber 148. The cover 116 also includes apertures 180 for receiving electrical leads 134 and 136.

The carrier 118 has a cylindrical main body 182 portion with a diameter of approximately one-third of the diameter of the housing 114. The main body portion 182 has a cylindrical outer surface 184 (FIG. 4) and two axial end surfaces, a bottom surface 186 and a top surface 188 (FIG. 3). The bottom surface 186 of the carrier 118 includes an annular groove (not shown). An actuator 190 extends from the top surface 188 of the carrier 118. The actuator 190 may include means for attaching a knob. The depth of the main body portion 182 is defined as the distance between the bottom surface 186 and the top surface 188.

A radial extension 192 extends from the outer surface 184 of the carrier 118 near the bottom surface 186. The radial extension 192 extends radially outward from the outer surface 184 of the carrier 118 a distance of approximately equal to the carrier diameter. The radial extension 192 forms an annular plate having a bottom surface 194 and a top surface 196. The annular plate has a depth of approximately 20% of the depth of the main body portion 182 of the carrier 118.

A plurality of undulations 198 (FIG. 4) extends around the outer surface 184 of the carrier 118. Each of the undulations 198 has a peak 200 that extends axially. Adjacent undulations 198 are separated by an axially extending groove 202.

An electrical conductor 204 (FIG. 3) is attached to the bottom surface 194 of the annular plate of the carrier 118. The electrical conductor 204 includes two W-shaped portions 206 and 208 that are interconnected by a connecting portion (not shown). A first W-shaped portion 206 extends from the annular plate in a position 180 degrees from a second W-shaped portion 208. Each of the W-shaped portions 206 and 208 has two legs 210 that attach to the bottom surface 194 of the annular plate and two arched portions 212 that extend axially away from the bottom surface 194 for contacting the printed circuit board 112.

To assemble the switch 110 of the FIGS. 3 and 4, the carrier 118 is inserted into the chamber 148 through the open end 138 of the housing 114 such that the actuator 190 extends through the central bore 154 on the top wall 142 of the housing 114. In this position, the outer surface 184 of the carrier 118 will be held between the two cantilever portions 156 and 158. The printed circuit board 112 is then fixed to the cover 116 such that the annular projection 178 extending inwardly from the inner surface 174 of the cover 116 extends through the central aperture 120 of the printed circuit board 112. The electrical leads 134 and 136 of the printed circuit board 112 are extended through of the apertures 180 in the cover 116 and the cover 116 is attached to the housing 114. When the cover 116 is attached to the housing 114, the printed circuit board 112 will contact the electrical conductor 204 of the carrier 118. The first W-shaped portion 206 of the electrical conductor 204 will contact the first side 124 of the printed circuit board 112 and the second W-shaped portion 208 of the electrical conductor 204 will contact the second side 126 of the printed circuit board 112. When the printed circuit board 112 contacts the electrical conductor 204, a portion of the annular projection 178 extending from the inner surface 174 of the cover 116 enter the annular groove (not shown) on the bottom surface 186 of the carrier 118. The annular projection 178 supports the carrier 118 for rotation relative to the printed circuit board 112.

The switch 110 of FIGS. 3 and 4 operates in a manner similar to the switch of FIGS. 1 and 2 with the exception that the carrier 118 is rotated instead of moved linearly. The top wall 142 of housing 114 may have means for limiting rotation of the carrier 118 relative to the housing 114 so that the carrier 118 must be moved in opposite rotational directions when moving from the "on position" to the "off position" and from the "off position" to the "on position."

Figure 5A:
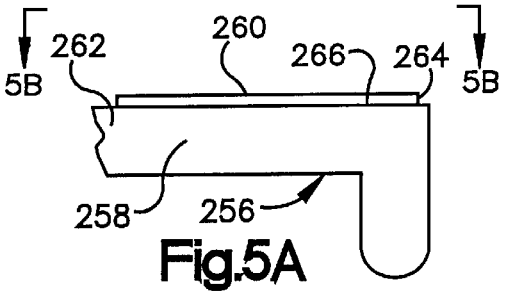
FIG. 5*a* is a side view of a flexible cantilever portion of the present invention having a ribbed arm portion.
Figure 5B:
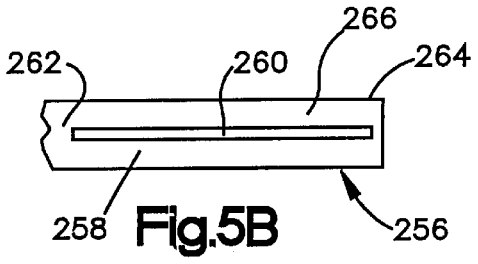
FIG. 5*b* is a view taken along line 5*b*—5*b* in FIG. 5*a*.

FIGS. 5*a* and 5*b* show views of a flexible cantilever portion 256 of the present invention having a ribbed arm portion 258. The rib 260 on the arm portion 258 extends axially, i.e., from the first axial end 262 of the arm portion 258 to the second axial end 264, along the outer wall 266 of the arm portion 258. The ribs 260 provide rigidity to the arm portion 258. By making the arm portion 258 more rigid, the resistance to movement of the carrier will increase. Other ways to increase the rigidity of the arm portion 258 include increasing the thickness of the arm portion 258 and inserting a rigid material such as glass or a resilient metal wire into the arm portion 258.

Figure 6:
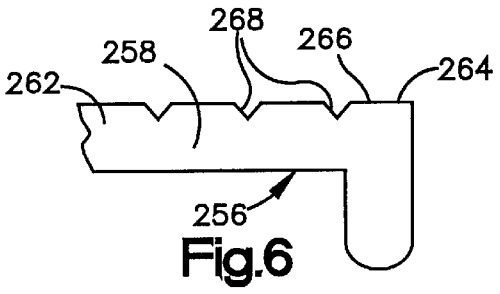
FIG. 6 is a view of a flexible cantilever portion of the present invention having a slotted arm portion.

FIG. 6 shows a view of a flexible cantilever portion 256 of the present invention having a slotted arm portion 258. The slots 268 on the arm portion 258 extend laterally, i.e., perpendicular to the axial direction, along the outer wall 266 of the arm portion 258. The slots 268 increase the flexibility of the arm portion 258. By making the arm portion 258 more flexible, the resistance to movement of the carrier will decrease. Other ways to increase the flexibility of the arm portion 258 include decreasing the thickness of the arm portion 258.

From the above description of the invention, those skilled in the art will perceive improvements, changes and modifications. Such improvements, changes, and modifications may include changes to the slope of the undulations to vary the resistance of movement of the carrier or modifying the configuration of switch such that one or more of the cantilevered portions extend from the cover. Such improvements, changes and modifications within the skill of the art are intended to be covered by the appended claims.

Having described the invention, the following is claimed:

1. A switch comprising:

a printed circuit board having a plurality of electrical contacts, a carrier having an electrical conductor for connecting at least two of the plurality of electrical contacts, the carrier being movable relative to the printed circuit board;

the carrier further having a surface with a plurality of undulations; and a plastic member housing the carrier, said plastic member including a chamber and at least one flexible plastic cantilever portion, the at least one cantilever portion having an arm portion and a head portion, the head portion of the cantilever portion contacting the plurality of undulations;

the undulations and the cantilever portion comprising a detent mechanism to restrain the carrier in a position to which the carrier is moved, the carrier being supported within the central chamber for linear movement in a first direction relative to the printed circuit board, the chamber being partially defined by a planar inner surface, the arm portion of the cantilever portion extending perpendicularly away from the inner surface and into the chamber in a second direction transverse to the first direction, the head portion of the cantilever portion extending away from the arm portion and parallel to the inner surface.

2. The switch as in claim 1 further being defined by:

a top surface of the carrier having the plurality of undulations; and each undulation having a peak that extends perpendicular a direction of linear movement of the carrier.

3. The switch as in claim 1 further being defined by:

the arm portion extending from the plastic member for supporting the head portion, the arm portion having an inner surface and an outer surface, the inner surface being nearest the carrier and the outer surface being opposite the inner surface; and the head portion extending inwardly from the inner surface of the arm portion to engage the surface of the carrier.

4. The switch as in claim 3 further being defined by:

the outer surface of the arm portion of the flexible cantilever portion having at least one axially extending rib for making the arm portion more rigid.

5. The switch as in claim 3 further being defined by:

the outer surface of the arm portion of the flexible cantilever portion having at least one laterally extending slot for making the arm portion more flexible.

6. A switch comprising:

a printed circuit board having a plurality of electrical contacts, a carrier having an electrical conductor for connecting at least two of the plurality of electrical contacts, the carrier being movable relative to the printed circuit board;

the carrier further having a surface with a plurality of undulations; and a plastic member housing the carrier, the plastic member including a chamber and at least one flexible plastic cantilever portion, the at least one cantilever portion having an arm portion and a head portion, the head portion of the cantilever portion contacting the plurality of undulations;

the undulations and the cantilever portion comprising a detent mechanism to restrain the carrier in a position to which the carrier is moved, the carrier being supported within the chamber for rotary movement relative to the printed circuit board, the chamber being partially defined by a cylindrical inner surface, the arm portion of the cantilever portion extending parallel to the inner surface and into the chamber, the head portion of the cantilever portion extending away from the arm portion and radially inward away from the cylindrical inner surface.

7. The switch as in claim 6 further being defined by:

the carrier having a cylindrical outer surface;

the outer surface having the plurality of undulations; and each undulation having a peak that extends axially across the outer surface of the carrier.

* * * * *